US005161705A

United States Patent [19]

Takai

[11] Patent Number: 5,161,705

[45] Date of Patent: Nov. 10, 1992

[54] DISMOUNTING DEVICE FOR HEAVY LOAD HOISTING MEMBER

[75] Inventor: Seiichiro Takai, Tokyo, Japan

[73] Assignee: Totetu Mfg. Co., Ltd., Tokyo, Japan

[21] Appl. No.: 697,879

[22] Filed: May 9, 1991

[30] Foreign Application Priority Data

May 11, 1990 [JP] Japan ..... 2-122062

[51] Int. Cl.[5] ..... B66C 1/12

[52] U.S. Cl. ..... 212/271; 294/75; 294/82.24

[58] Field of Search ..... 294/75, 82.1, 82.11, 294/82.16, 82.17, 82.24; 212/271, 146, 242, 251, 259

[56] References Cited

U.S. PATENT DOCUMENTS

| | | | |
|---|---|---|---|
| 2,673,116 | 3/1954 | Baird | 294/75 |
| 4,149,746 | 4/1979 | Androski | 294/75 |
| 4,181,342 | 1/1980 | Funk | 294/75 |
| 4,293,155 | 10/1981 | Grant | 294/75 |
| 4,936,617 | 6/1990 | Greene et al. | 294/75 |

*Primary Examiner*—Jesus D. Sotelo
*Assistant Examiner*—Stephen P. Avila
*Attorney, Agent, or Firm*—McAulay Fisher Nissen Goldberg & Kiel

[57] ABSTRACT

After a heavy load hoisted up by a hoisting member is downed on the predetermined place, the hoisting member can be automatically dismounted from the heavy load by using the dismounting device. The hoisting member consists of a upper hoisting member and a lower hoisting member. The upper hoisting member is arranged between a base of the dismounting device and a hook of a crane. The lower hoisting member has a foundation and secured to the base, a mid portion engaged with a hoisting member engagement portion of the heavy load, and a front end fitted or inserted onto a mast erected on the base. In operation, a slider up-and-down slidably mounted on the mast is pushed up by a resilient body, in its no load condition, to a level where its top end reaches at least a top end of the mast. The slider is adapted to conquer resilient force of the resilient body while the slider hoists the base. When the heavy load hoisted is downed on the predetermined position, a slider downing device is made inoperative and the slider is pushed up by resilient force of the resilient body, resulting in sweeping aside the ring of the hoisting member or wire engaged with the mast. Then the crane raises the base of the dismounting device, thereby the lower hoisting member passes through the engagement portion and separated from the heavy load.

9 Claims, 10 Drawing Sheets

DISMOUNTING DEVICE FOR HEAVY LOAD HOISTING MEMBER

BACKGROUND OF THE INVENTION

1. Field of the Invention

The present invention relates to a dismounting device for dismounting a hoisting member, such as wire, cable, rope, and chains hoisting a heavy load, from the heavy load.

2. Prior Art

According to the prior art, after heavy loads of construction material used in construction works and civil engineering works are hoisted by a crane by means of a hoisting member, such as wire, and downed at the predetermined place, ordinarily operators dismount or disengage the wire engaged with the heavy load.

In case, unfortunately, the predetermined place is under water, such as erection of waterbreaks and banks, and repairment of them, and the operators or workers of the construction work are difficult to approach there, wire of the hoisting member has been discarded there under water together with heavy load, for example, of net cages containing stones (for example, Patent Publication No. 51-12322).

However, when a number of heavy loads of such net cages containing stones are arranged or used being discarded on sea shores and piers, the total construction cost is raised because wire is very expensive. In order to save money, wire under water has been dismounted by a driver, but the wire dismounting operation is not apparently easy according to climate condition and installation condition of the heavy load. Consequently, it has been necessary to improve the construction work.

SUMMARY OF THE INVENTION

Accordingly, it is the purpose of the present invention to provide a dismounting device for heavy load hoisting member enabling to automatically dismount the hoisting member engaged with the heavy load, when the load hoisted by means of the hoisting is downed at the predetermined place, from the heavy load.

Referring now to the drawings, wherein the reference numerals in the different views identify identical parts.

Figure 1:
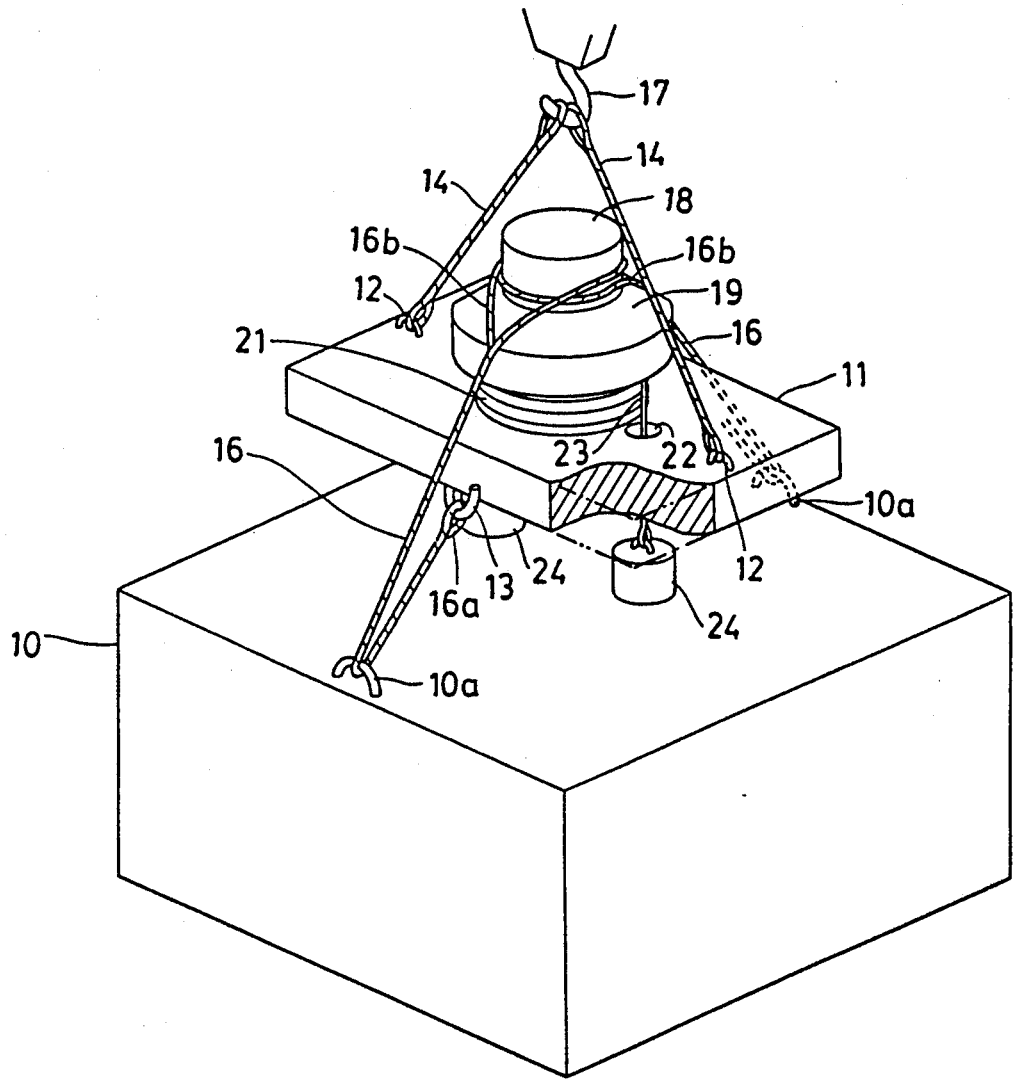
FIG. 1 is a perspective view of the hoisting member dismounting device of one embodiment according to the present invention.

First, the construction of the dismounting device solving the problem, according to the present invention, will be described with reference to FIG. 1. The present invention concerns a device, as shown, for dismounting the hoisting member 16, engaged with the heavy load or goods 10 provided with a hoisting member engagement portion 10*a*, from the heavy load 10. The dismounting device consists of a base 11, a upper hoisting member 14 having its foundation end fixed to the base 11 and its front end adapted to be engageable with a hook 17 of the crane, a mast 18 erected on the base 11, a lower hoisting member 16 having a ring 16*b* provided with its foundation end fixed to the base 11 and its front end of a size enabling to insert through the mast 18, which lower hoisting member 16 being engaged with a hoisting member engagement portion 10*a* of the heavy load 10, a slider 19 arranged on the mast 18 so as to vertically move, resilient body 21 for pushing up the slider 19 in a no load condition to the level at which a top end of the slider corresponds at least to the top end of the mast 18, and a pair of means 23 and 24 for downing the slider 19 conquering a resilient force of the resilient body 21 when the hoisting member 14 hoists the base 11.

The operation of the dismounting device will be explained. When the heavy load 10 hoisted up by the crane is lowered on the predetermined place using the upper hoisting member 14 and the lower hoisting member 16, the slider downing means 23 and 24 are made of non-operative and the slider 19 is pushed up by a resilient force of the resilient body 21, resulting in a sweeping-aside of the ring 16*b* engaged with the mast 18 out of the mast 18. Then, raising the base 11 by the crane makes the lower hoisting member 16 dismounted from the heavy load 10 passing through the hoisting member engagement portion 10*a*.

Next, embodiments of the present invention will be explained in detail with reference to the accompanying drawings.

As shown in FIGS. 1 to 5, the heavy load 10 in the first embodiment of the dismounting device is a concrete block, which having inverted U shape wire engagement portion 10*a* and 10*a*, respectively secured to the center between both end edges of the concrete block. The dismounting device of the hoisting device has a thick plate base 11 of a square. The base 11 has a pair of inverted U shape hooks 12 and 12, respectively secured to the mid portion between the left and right end edges of the upper face of the base 11, and also another apri of J shape hooks 13 and 13, each secured to the mid portion between the front and rear end edges of the bottom face of the base 11.

The foundation end of the upper wire 14 is engaged with the hook 12 and the foundation end of the lower wire 16 is engaged with the hook 13. The foundation end of the lower wire 16 has a first ring 16*a* and the first ring 16*a* is engaged dismountably with the J shape hook 13. A front end of the upper wire 14 is engaged with the hook 17 of the crane. The cylindrical column shape mast 18 is erected at the center of the base 11. The foundation end of the mast 18 is inserted through the base 11 and welded there. The lower wire 16 is engaged with the wire engagement portion 10*a* of the heavy load 10. A second ring 16*b* insertable through the mast 18 is formed at the front end of the lower wire 16.

It is apparent that the cylindrical slider 19 is loosely inserted through the mast 18. The resilient body 21 consisting of a coil spring is loosely inserted through a part of the mast 18 between the base 11 and the slider 19. A coefficient of elasticity of the elastic or resilient body 21 is determined to effectively raise the slider 19 to the level where the top end of the slider 19 reaches at least the top end of the mast 18 when the slider 19 has no load. A spacer 20 for protecting the coil spring 21 compressed is placed at a part of the mast 18 between the base 11 and the slider 19. According to the first embodiment, the spacer 20 is integrally formed on the mast 18 and has an outer diameter larger than the inner diameter of the slider 19. The top portion of the slider 19 is formed of a cone shape so as to make the ring 16*b* of the wire 16 easy in dropping when the slider 19 rises. On the part of the base 11 confronting the bottom face of the slider 19, there are through holes 22 and 22 through which holes pending wires 23 and 23 pass. The pending wires 23 and 23 pending from the left and the right parts of the bottom face of the slider 19 have weights 24 and 24 formed thereto. Mass of the weight 24 is sufficient to down the slider 19 conquering the resilient force of the resilient body 21 when the base 11 is hoisted.

The usage process of the dismounting device for the hoisting member having such construction above will be explained.

First, in order to hoist the base 11 placed on the ground, the front ends of the upper wires 14 and 14 are engaged with the hook 17 of the crane raising the base 11. When the weights 24 and 24 are floated, the hoisting operation is halted. Then, due to the dead load of the weight 24, the slider 19 downs against the resilient force of the resilient body 21 and the top end of the mast 18 is exposed from the slider 19. The second rings 16*b* and 16*b* of the lower wires 16 and 16, respectively are inserted through the top end of the mast 18 and engaged there.

Figure 2:
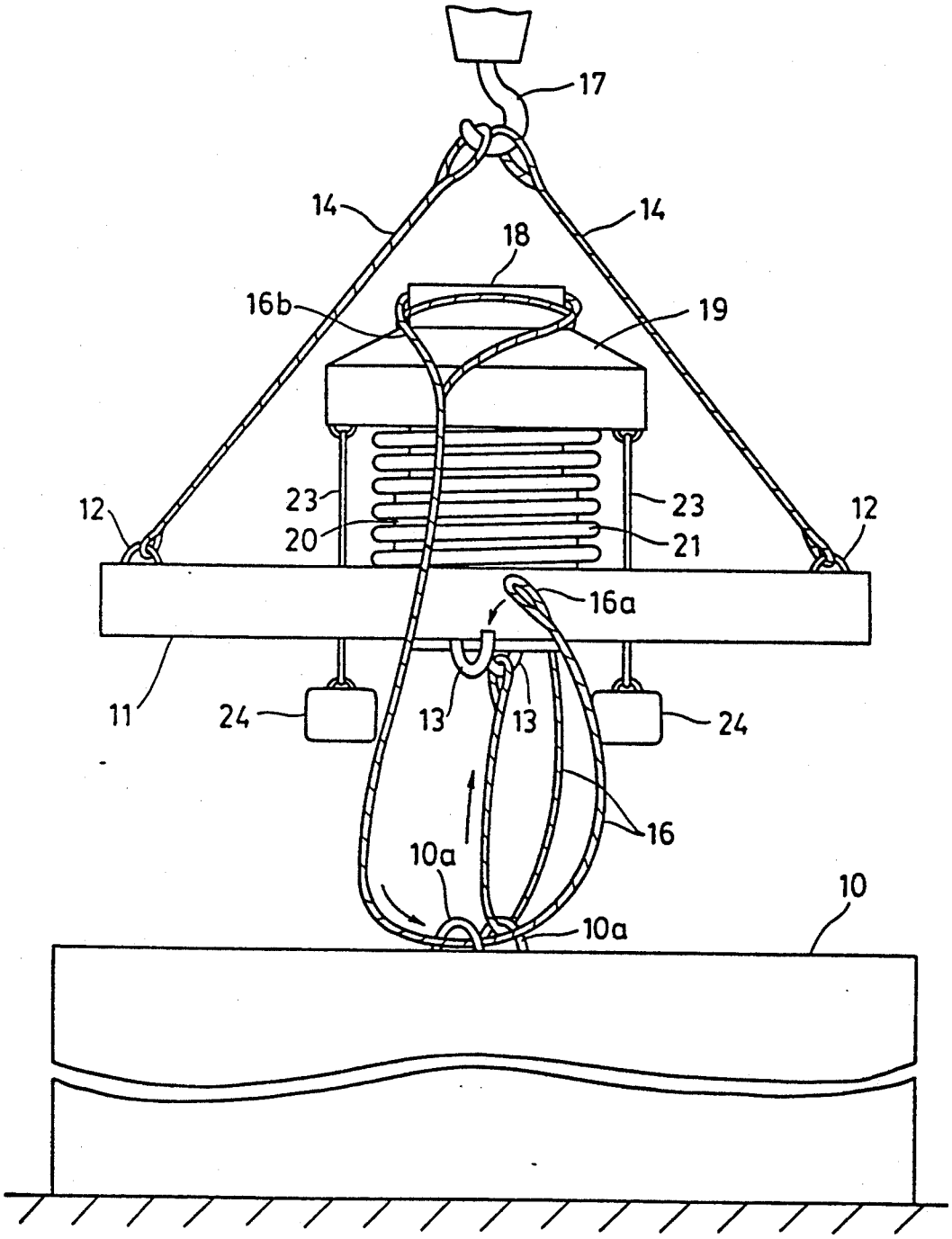
FIG. 2 is a broken front view of an important portion of the dismounting device and shows a usage of the device in a situation of loosening the device.

Next, as shown in FIG. 2, after the base 11 is raised by the crane and moved to a place just above the heavy load 10, the first rings 16*a* and 16*a* of the lower wire 16, respectively are inserted through the wire engagement portions 10*a* and 10*a* of the heavy load 10 and engaged with the J shape hooks 13 and 13.

Figure 3:
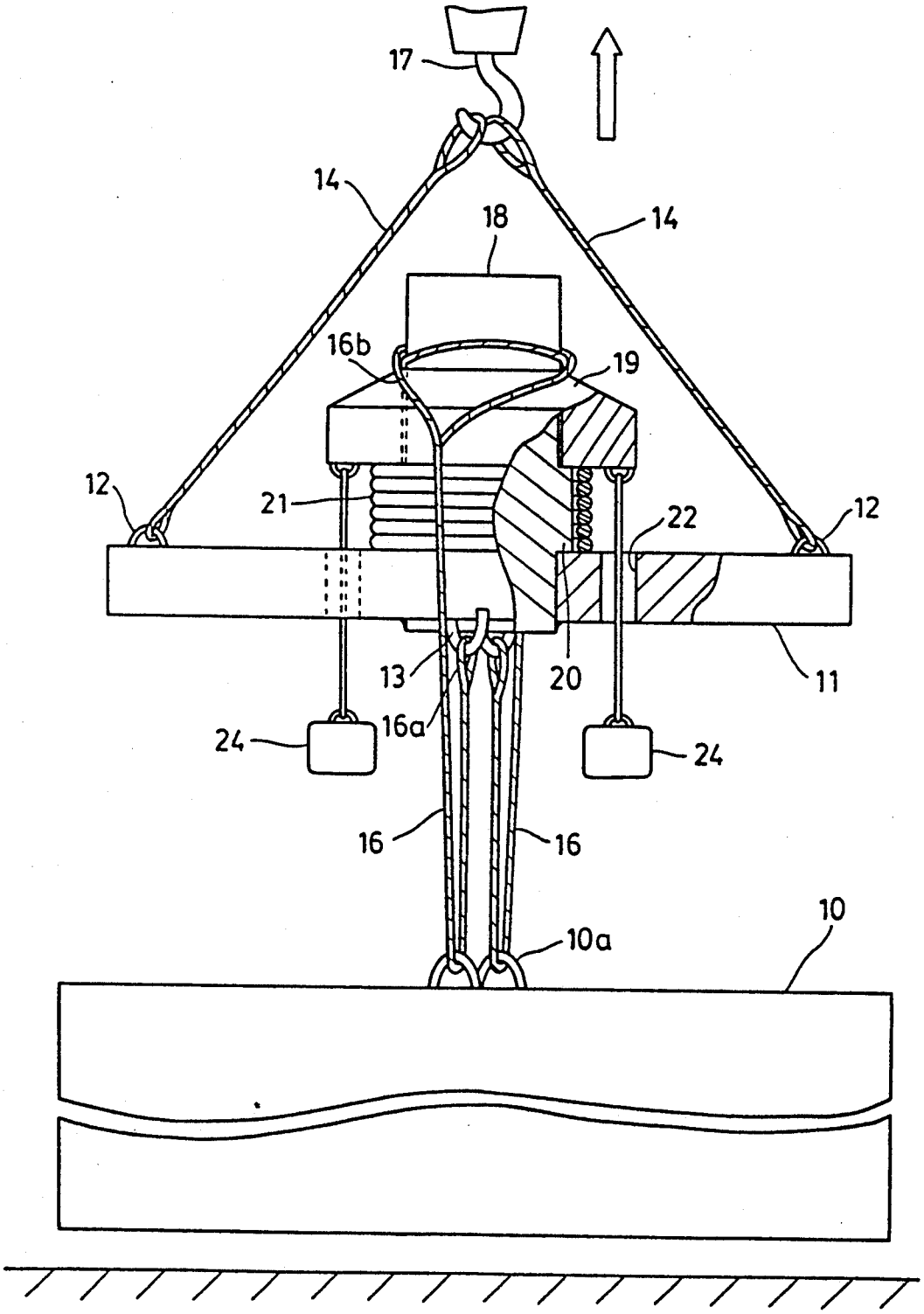
FIG. 3 is also another front view of the important portion of the dismounting device and depicts a usage of the device in another situation of tensioning the device.

When the crane rises the heavy load 10 through the upper wires 14 and 14, the base 11, and the lower wires 16 and 16 as shown in FIG. 3, the lower wires 16 and 16 are tensed and the slider 19 further descends due to the dead load of the heavy load 10, compressing the resilient body 21. When the top end of the spacer 20 strikes the lower end of the slider 19, the slider 19 stops. They are transferred together with the heavy load 10 to the predetermined place G.

Figure 4:
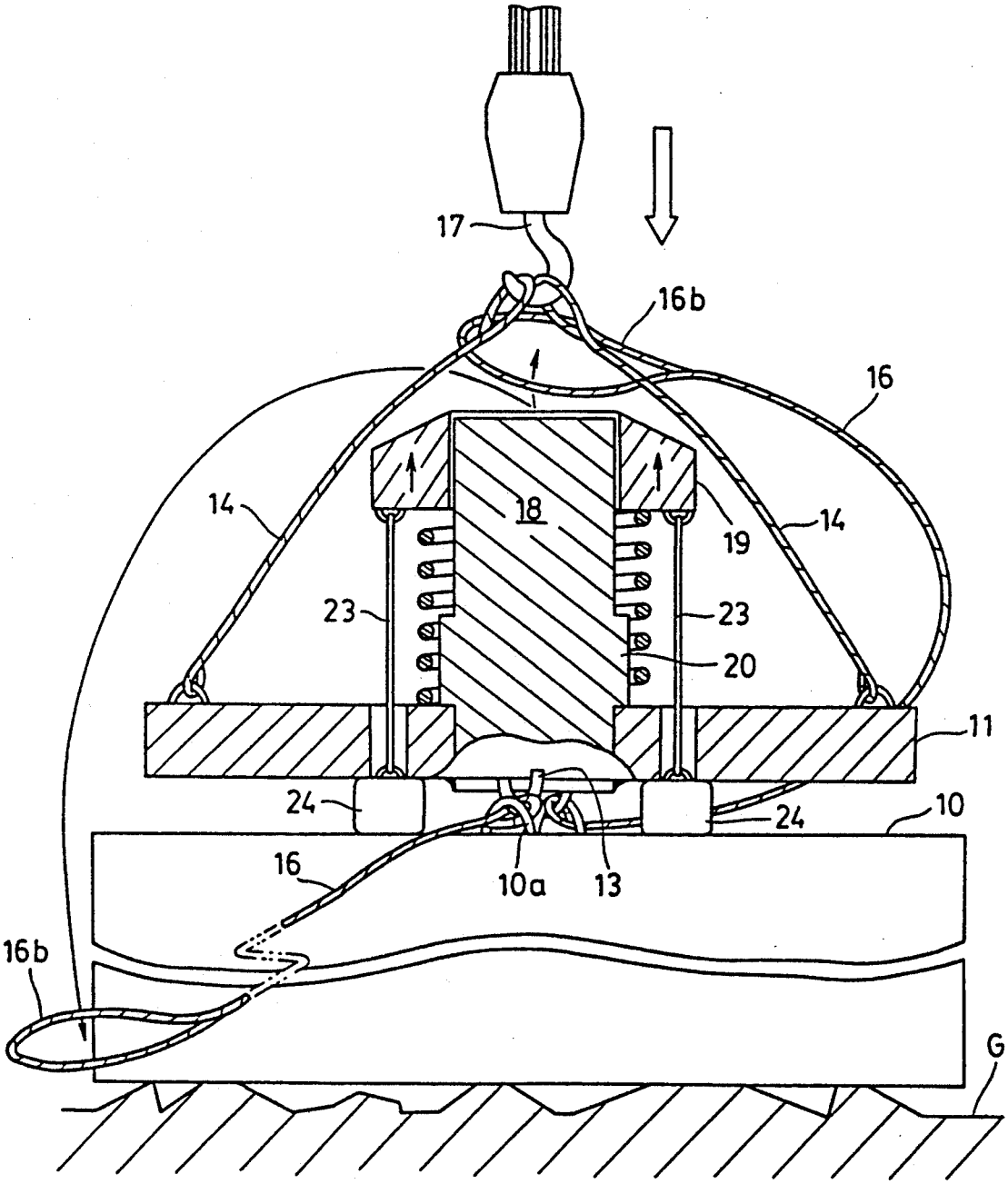
FIG. 4 is a still another front view of the important portion of the device when it is loosen.

When the heavy load 10 is downed on the place G, the weights 24 and 24 strike the top surface of the heavy load 10 as shown in FIG. 4 and the base 11 further rides on the weights 24 and 24. The resilient force of the resilient body 21 pushes up the slider 19 to the level where the top end of the slider 19 overrides a little the top end of the mast 18. Consequently, the second rings 16*b* and 16*b*, respectively engaged with the top end of the mast 18 are dismounted from the mast 18 and downed.

Figure 5:
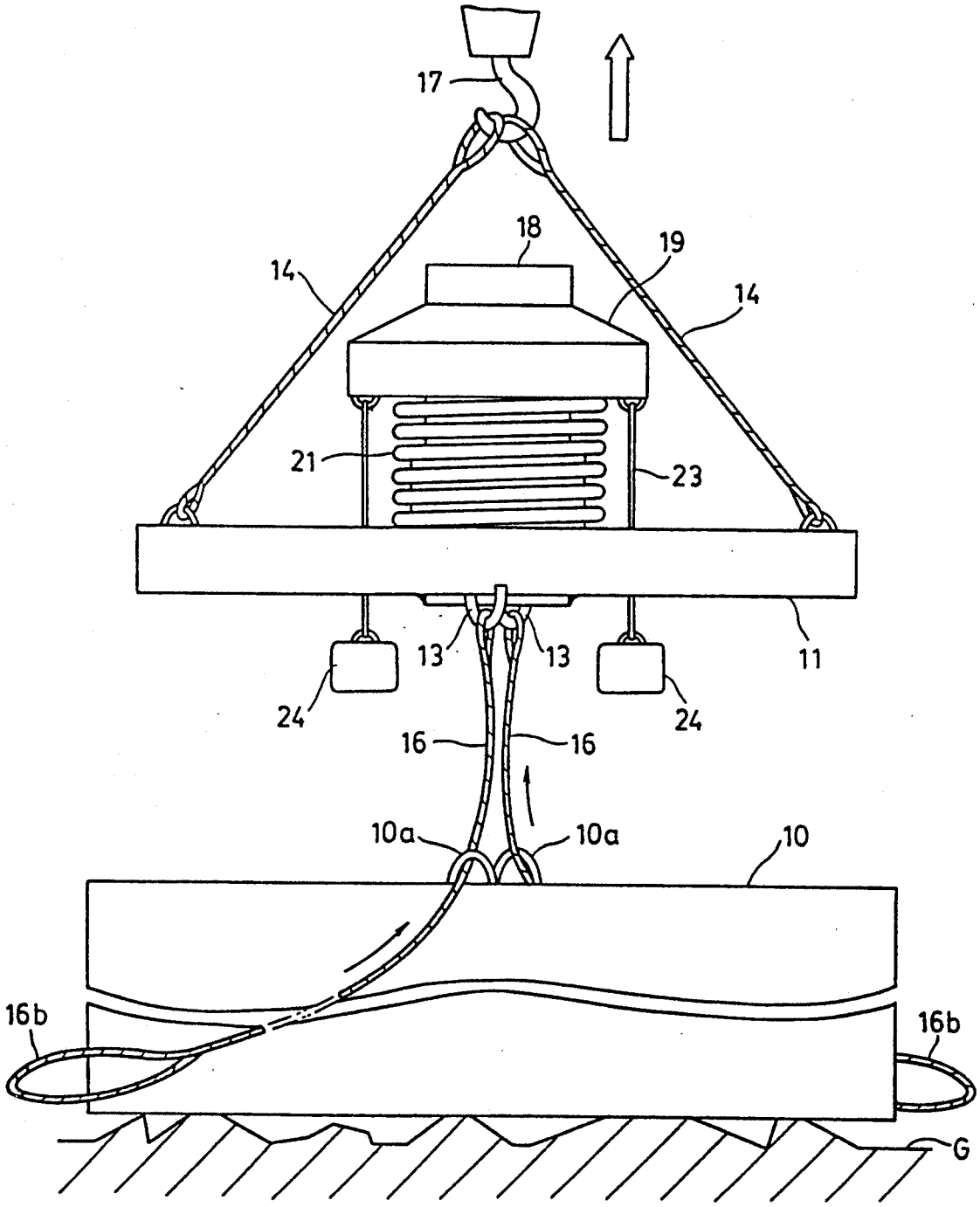
FIG. 5 is a still another front view of the important portion of the device before the hoisting member is dismounted.

As apparently shown in FIG. 5, then the crane raises the base 11, consequently the lower wires 16 and 16 are dismounted or disengaged from the heavy load 10 passing through the wire engagement portion 10*a* of the heavy load 10. As a result, the wire 16 is automatically released from the heavy load 10 placed on the predetermined place G.

Another embodiment of the dismounting device according to the present invention will be explained with reference to FIGS. 6 and 7. According to the second embodiment, the heavy load 25 is a net cage 27 in which stones 26 are filled so as to obtain a foundation of the waterbreak constructed under water. The net cage 27 has a upper frame 28 with which wires are engaged. The dismounting device of the hoisting member has a base 31 of a frame constructed by the H shape steel. Four inverted U shape hooks 32 .... 32 are fixed to the four corners of the top surface of the base 31.

Explicitely the foundation end of the upper wire (shown in broken lines) is engaged with the hook 32 and the foundation end of the lower wire 36 is engaged with the hook 33. The foundation end of the lower wire 36 has the first ring 36*a* and the first ring is engaged with the hook 33 through dismountable engagement devices 36*c*. Ten lower wires 36, respectively are engaged with the wire engagement portion 28 of the heavy load 25 and pass through ten inverted U shape guides 35 fixed to the top surface of the base 31. The second ring 36*b* formed at the front end of the lower wire 36 is inserted onto the mast 38. Each front end of four upper wires 34 is engaged with the hook 37 of the crane.

The frames 31*a* and 31*a* consisting of the H-steel have a foundation stand 31*b* of the H-steel mounted thereon. As shown in detail in FIG. 7, similar to the previous embodiment of the present invention, a round column-like mast 38 is erected on the centeral position of the foundation stand 31*b*. Stationally pulleys 31*c* and 31*c* are arranged on the top surface. A cylindrical slider 39 is loosely fitted on the mast 38, and a resilient body 41 consisting of a coil spring having a coefficient of elasticity corresponding to that of the previous first embodiment is loosely fitted on a part of the mast 38 between the foundation stand 31*b* and the slider 39.

A cylindrical spacer 40 having the same function as that of the first embodiment is mounted on a part of the mast 38 between the foundation stand 31*b* and the slider 39. Similar to that of the first embodiment, the slider 39 has a cone-like top portion and engagement rings 39*a* and 39*a*, respectively fixed to both sides of the slider 39. Respective one end of the tension members 39*b* and 39*b* are secured to the engagement rings 39*a* and 39*a*. Other ends of the tension members 39*b* and 39*b* are engageable with the hook 37 of the crane after passing through stationally pulleys 31*c* and 31*c*. The tension members 39*b* and 39*b*, and the upper wire 34 are adapted to be engaged with the hook 37 of the crane, thereby these tension members 39*b* and 39*b* become of tensed condition when the crane tries to raise the heavy load or net cage 25. Consequently, tension of the tension members 39*b* and 39*b* makes the slider 39 down conquering resilient force of the resilient body 41.

The usage method of the dismounting device for the hoisting member having the construction above according to the second embodiment is the same as that of the first embodiment, so the explanation of the usage method is omitted from the description.

Figure 7:
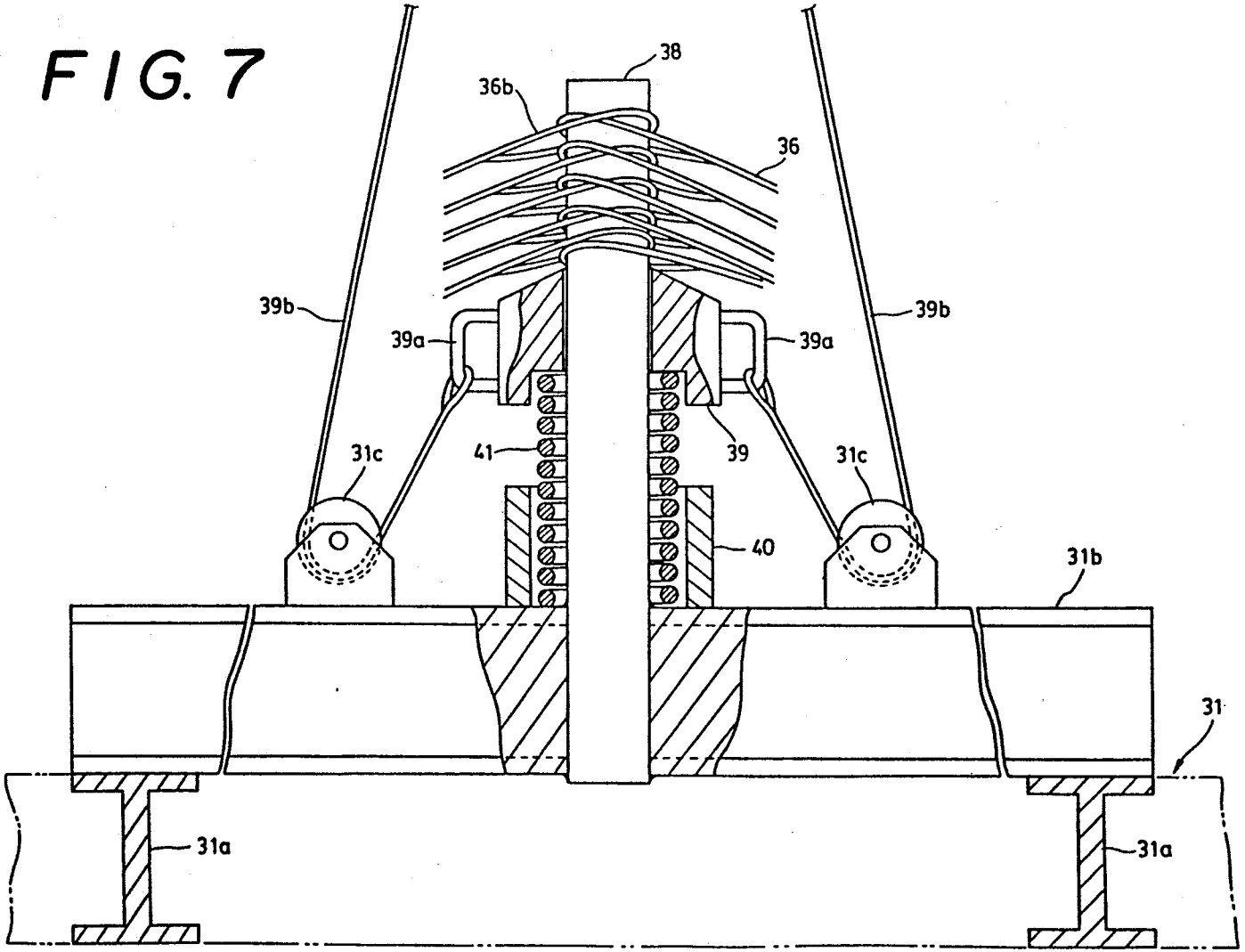
FIG. 7 is an enlarged section of the important portion of the dismounting device.
Figure 8:
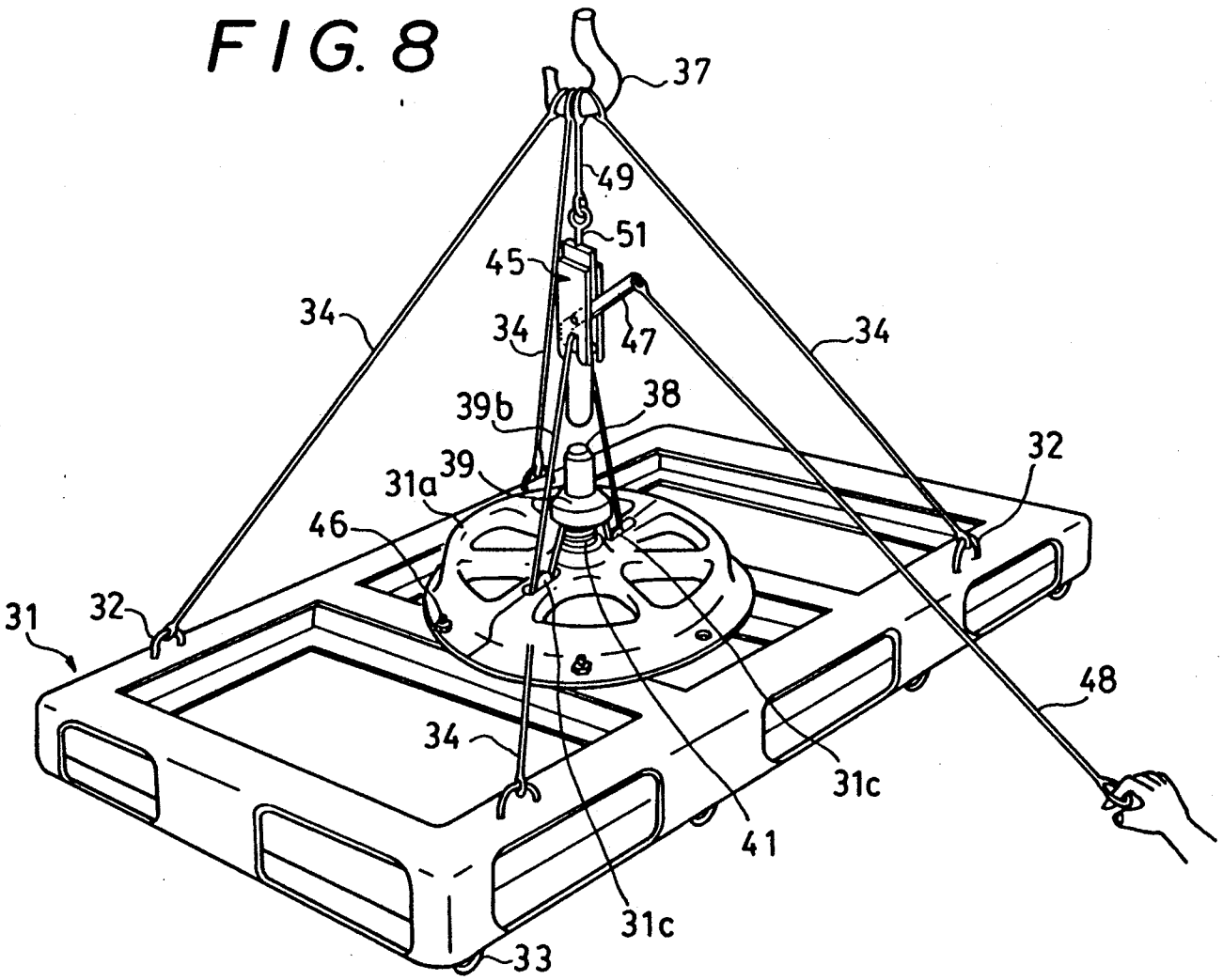
FIG. 8 is a perspective view of the dismounting device for the hoisting member according to still another embodiment of the present invention.

Next, the third embodiment of the present invention will be explained with reference to FIG. 8. Referring to FIG. 8, wherein the same reference characters and numbers as that of FIG. 6 and 7 designate the same or corresponding parts throughout the several views. According to the third embodiment, the tension member 39*b* is adapted to be engaged with the hook 37 of the crane through a releaser 45. From the drawing of FIG. 8, the heavy load 25 and the lower wire 36 for hoisting the load of the previous embodiments are omitted in order to clarify the drawing.

A circular foundation stand 31*a* is secured to the base 31 by means of bolts 46. The foundation stand 31*a* is made of two semi-circular castings, and the mast 38 is erected at the center of the foundation stand 31*a*. Both ends of one tension member 39*b* are secured to the slider 39 which is slidable on the mast 38. The tension member 39*b* is held on the stationally pulleys 31*c* and 31*c* arranged on the top surface of the foundation stand 31*b* and a releasing lever 47 of the releaser 45. One end of a control rope 48 is connected to the releasing lever 47.

Figure 9:
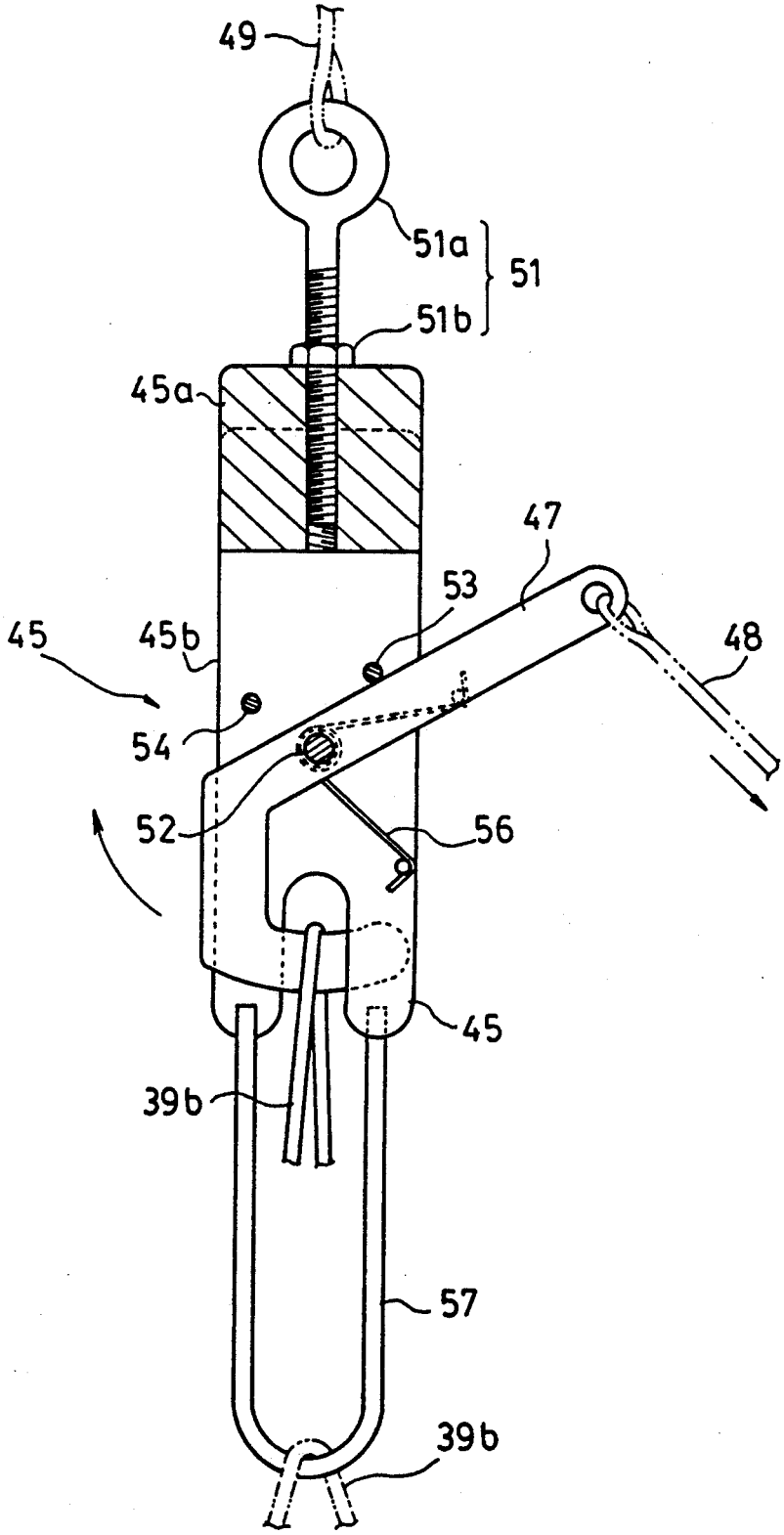
FIG. 9 is a section of a releaser of the dismounting device.
Figure 10:
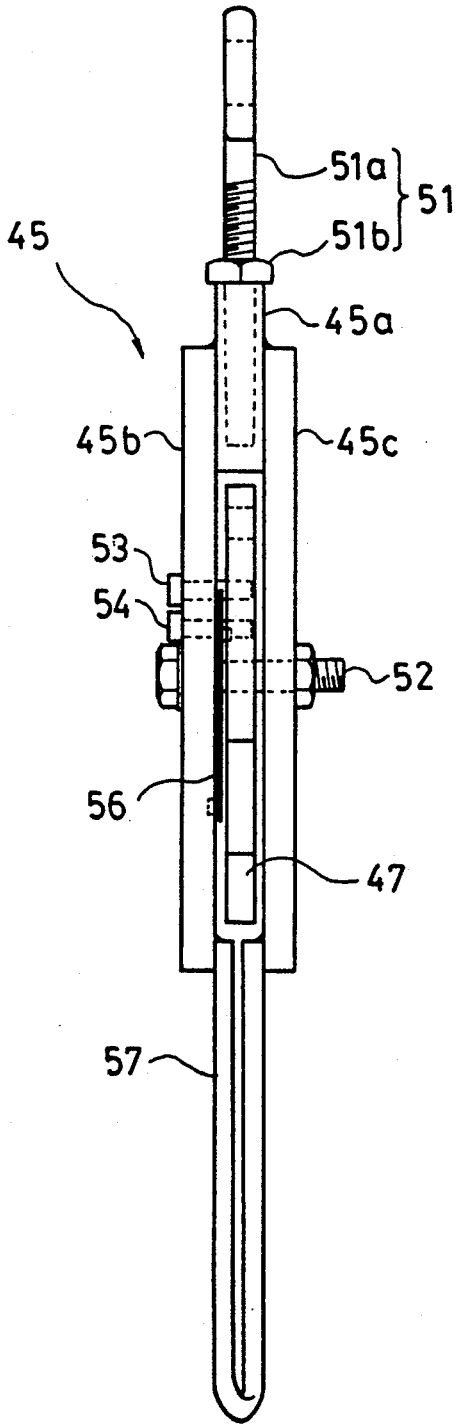
FIG. 10 is a front view of the releaser.
Figure 11:
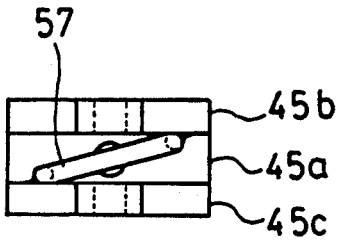
FIG. 11 is a bottom view of the releaser consisting of a short plate, a long plate, and a tension member receiver.

As apparently shown in FIGS. 9–11, the releaser 45 has a short plate 45*a*, and a long plates 45*b* and 45*c*, respectively secured to both sides of the short plate 45*a*. The short plate 45*a* has a hook engagement portion 51 engageable with the hook 37 of the crane through the wire 49. According to the third embodiment of the dismounting device for the hoisting member, the hook engagement portion 51 has a lifting bolt 51*a* so threaded in the short plate 45*a* as to be controlled of its length, and a lock nut 51*b* for securing the bolt 51*a* to the short plate 45*a*.

It is apparent from FIG. 9 that the releasing lever 47 is journalled on a shaft 52 secured at about the center of the long plates 45*b* and 45*c*. Stopper pins 53 and 54 for the releasing lever 47 are secured on an inner face of the long plate 45*b*. The lever 47 is adapted to abut against the stopper pin 53 due to resilient force of the coil spring 56 wound around the shaft 52 when the control rope 48 is not pulled. The long plates 45*b* and 45*c*, respectively have forked lower ends as shown in FIG. 9. The lower end portion of the lever 47 is adapted to be seen in a space between legs of the forked end. As shown in detail in FIG. 11, both ends of the U shape tension member receiver 57 are secured by welding to the inner faces of the lower end of the long plate 45*b* and the lower end of other long plate 45*b*, which doesn't face to the former lower end.

The usage process of such constructed dismounting device for the hoisting member will be described.

First, as shown in FIG. 9 by a solid line, the central portion of the tension member 39*b* is hooked on the lower end of the releasing lever 47 so as to hoist-up the base 31 by the crane through the upper wire 34. When the wire 49 and the tensed member 39*b* are not tensed and the slider 39 is not downed, the lock nut 51*b* is made loosen so as to control the length of lifting bolt 51*a*. After such control exposes the post 38 as shown in FIG. 8, the base 31 is moved above the heavy load (not shown) and rings of a plurality of lower wire suspending the heavy load is fitted onto the post 38 similar to that of the previous embodiments of the present invention.

Figure 6:
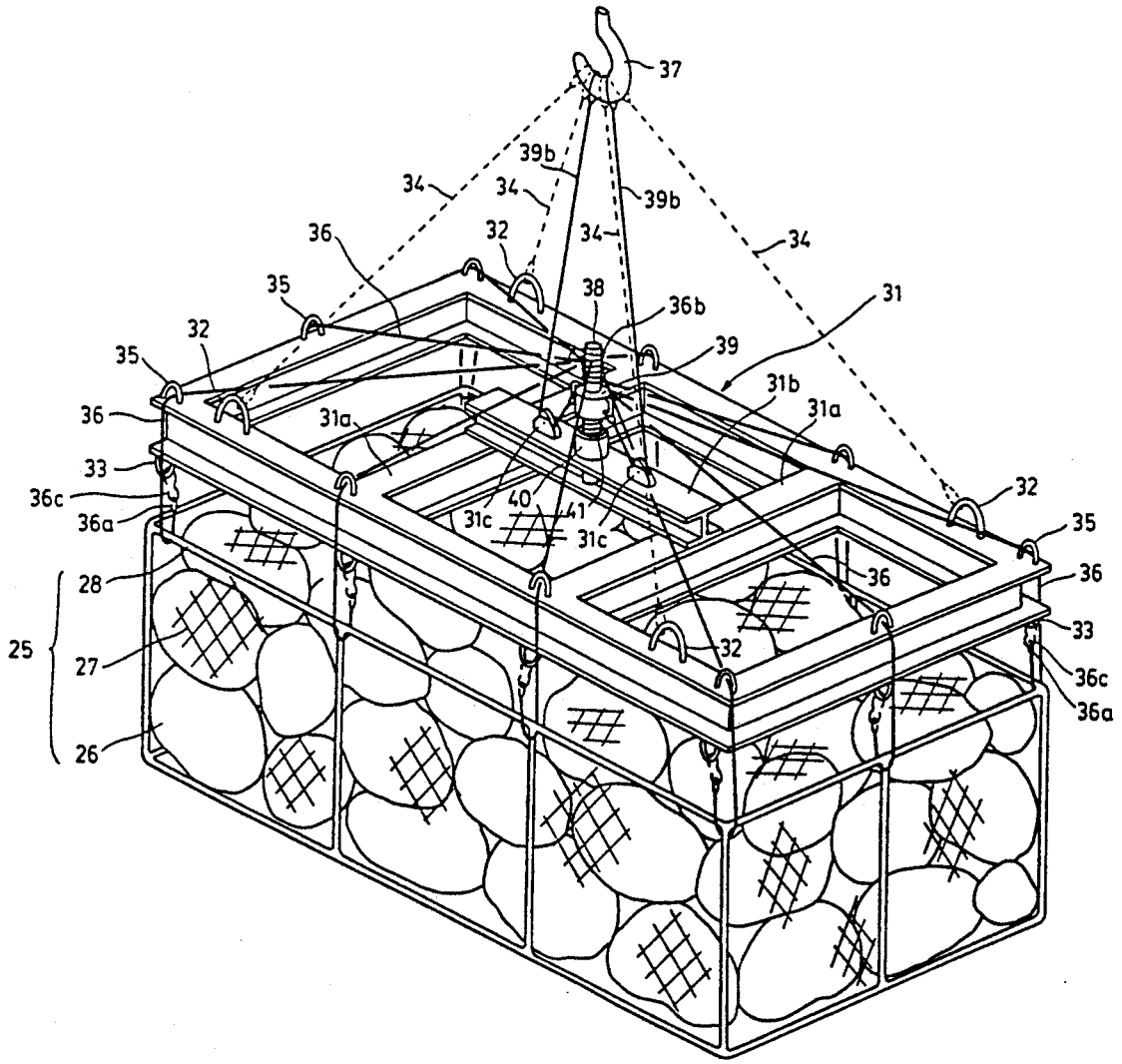
FIG. 6 is a perspective view of the dismounting device for the hoisting member according to another embodiment of the present invention.

When the heavy load can be lowered on any place and the heavy load is, for example as shown in FIG. 6, the net cage containing stones for constructing the foundation of the waterbreak erected under water, the heavy load is hoisted, and simultaneously the control rope 48 is pulled so as to rotate the releasing lever 47 along the direction shown by the solid line in FIG. 9. On the contrary, when the place on which the heavy load is downed is severely restricted, the releasing lever 47 is similarly rotated when the heavy load reaches the target position. Then, the stopper pin 54 stops the releasing lever 47, the tension member 39*b* is disengaged from the lower end of the lever 47, the tension member 39*b* downs on the tension member receiver 57 with the upper wire 34 tensed, freeing a tension of the tension member 39*b*. When the heavy load is landed on the predetermined place after the freeing above, the slider 39 is raised more easily than that of the embodiments so as to sweep aside a ring of the lower wire (not shown) from the post 38 so as to release the lower wire from the heavy load landed in a more shorter time.

The embodiments of the present invention, in which the dismounting device for the hoisting member of the present invention is used in a civil engineering work, have described, however the case to which the dismounting device of the present invention is applied is not limitted to the embodiments and the dismounting device can be used also in such case when the operator is difficult to safely or sanitarily access the heavy load installation site.

In the previous embodiments, wire is used as the hoisting member, pending member, and tension member, but cable, rope, and chain and the like can be used for wire.

The shape and structure of the mast, the slider, and the resilient body has been described and shown as examples of them, however any other shape and structure can be employed if they have the same or similar functions.

Describing the effect of the present invention, when the heavy load is downed on the predetermined place, a ring of the hoisting member mounted on the slider pressed by the resilient member is dismounted, so that a raising of the base by the crane to be carried out after the dismounting of the ring automatically dismounts the hoisting member from the heavy load.

Consequently, it is possible to install easily heavy loads using a crane even at the place or construction site where operators can not be positioned for reasons of sanitary and safety.

In addition, when the tension member is adapted to be engaged with a hook of the crane through a releaser, it is possible to release tension of the tension member on the predetermined or desired position before the heavy load lands and to dismount the lower wire from the heavy load without difficulty.

What is claimed is:

1. A dismounting device for dismounting a heavy load hoisting member from a heavy load having hoisting member engagement portions, comprising:

a base, an upper hoisting member having a foundation end secured to said base and a front end engageable with a hook of a crane, an upstanding mast having one end secured to the base and a top, unsecured end, a lower hoisting member having a foundation end secured to said base, a front end comprising a ring engageable onto the mast by placement over the top end thereof and a midportion engageable with the hoisting member engagement portions of the heavy load, a disengager slidably mounted on the mast, a resilient body in biased relationship with the disengager so as to move the ring of the lower hoisting member out of engagement with the mast in a no load condition, and antibias means for moving the disengager toward the secured end of the mast in opposition to the bias of the resilient body in a load position.

2. The dismounting device of claim 1 wherein the foundation end of the lower hoisting member is dismountably secured to the base.

3. The dismounting device of claim 1 wherein said mast is a circular column, the disengager is a cylinder insertable on the mast, and said resilient body is a coil spring loosely fitted on said mast.

4. The dismounting device of claim 3 further comprising a spacer for protecting the coil spring when it is compressed, said spacer being arranged between the base and said disengager.

5. The dismounting device of claim 1 wherein the disengager antibias means is a weight attached to the disengager.

6. The dismounting device of claim 1 wherein said antibias means comprises a stationally pulley arranged on the base, and a tension member provided with an end secured to the disengager and passing through the stationally pulley and having an end engageable with the hook of a crane.

7. The dismounting device of claim 6 wherein the tension member is engageable with the hook of a crane through a releaser adapted to release the tension on the tension member.

8. The dismounting device of claim 7 wherein said releaser comprises a hook engagement portion engageable with the hook of a crane, a releasing lever movable between releasing and non-releasing positions for holding the tension member while it is in a tensed condition and releasing the tensed condition of the tension member, a tension member receiver for holding said tension member after it is freed by an operation of the lever, and means for moving the lever between the releasing and non-releasing positions.

9. The dismounting device of claim 8 wherein said hook engagement portion comprises bolts threaded in the top end of the releaser and adapted to adjust the length of the releaser and a lock nut for securing the bolts to said releaser.

* * * * *